US005941736A

United States Patent [19]

Murakami

[11] Patent Number: 5,941,736

[45] Date of Patent: Aug. 24, 1999

[54] CONNECTOR AND METHOD OF ASSEMBLING SAME

[75] Inventor: Yoshihiro Murakami, Shizuoka, Japan

[73] Assignee: Yazaki Corporation, Tokyo, Japan

[21] Appl. No.: 09/053,777

[22] Filed: Apr. 2, 1998

[30] Foreign Application Priority Data

Apr. 3, 1997 [JP] Japan ..... 9-085212

[51] Int. Cl.[6] ..... H01R 13/40

[52] U.S. Cl. ..... 439/733.1

[58] Field of Search ..... 439/733.1, 869, 439/874, 875, 430

[56] References Cited

FOREIGN PATENT DOCUMENTS 2-278673 11/1990 Japan ..... H01R 13/46

*Primary Examiner*—Steven L. Stephan
*Assistant Examiner*—Eugene G. Byrd
*Attorney, Agent, or Firm*—Sughrue, Mion, Zinn, Macpeak Seas, PLLC

[57] ABSTRACT

A connector comprises a housing including a terminal receiving chamber into which a terminal is insertable; a partition wall dividing an internal space of the terminal receiving chamber into a first portion and a second portion, the partition wall having a hole through which the terminal is extended from the first portion into the second portion when the terminal is inserted into the terminal receiving chamber; and micro-capsules each containing an adhesive solution, the micro-capsules being provided at least on an inner surface of the hole. In the connector, when the terminal is inserted into the terminal receiving chamber, the micro-capsules are ruptured by a pressure produced when the terminal is fitted in the hole of the partition wall, so that the adhesive solution is released from the micro-capsules and adhesively bonds the terminal to the inner surface of the hole in a liquid-tight manner.

1 Claim, 3 Drawing Sheets

CONNECTOR AND METHOD OF ASSEMBLING SAME

BACKGROUND OF THE INVENTION

1. Field of the Invention

This invention relates to a connector and a method of assembling a connector which is used for connecting electric wires together. More particularly, this invention relates to a connector and a method of assembling a connector which is mounted in a through hole formed in a casing in which a liquid, such as lubricating oil, is circulated, and connects electric wires inside this casing to electric wires outside the casing in a liquid-tight manner.

2. Background

For example, in an automatic transmission (gear) of an automobile, electric wires, connected to solenoids and various sensors mounted inside a transmission casing so as to control the transmission, are connected respectively to electric wires of a control unit or the like, provided outside the transmission casing, through a connector mounted in a through hole formed in the transmission casing.

However, oil for lubricating the transmission is filled in the transmission casing, and therefore the connector is required to connect the electric wires inside the transmission casing to the electric wires outside the transmission casing while preventing the oil in the transmission casing from leaking to the exterior.

Therefore, a connector as shown in FIG. 3 has heretofore been used. In this connector 1, an inner plate 4 of an insulative resin is mounted on connection terminals 3 fixedly connected respectively to distal ends of electric wires 2 to be mounted inside a transmission casing. The electric wires 2, the connection terminals 3 and the inner plate 4 are inserted into a housing 5 through a left inlet 5*a* (FIG. 3) thereof, and then a rubber plug 6, mounted on the electric wires 2, is fitted into a right inlet 5*b* (FIG. 3) of the housing 5.

Then, an epoxy resin solution is poured into a space 7 within the housing 5 through a through hole (not shown) formed through the inner plate 4. Then, the epoxy resin is heated and set or cured, thereby sealing the space 7 liquid-tight by the cured epoxy resin.

When the connector 1 is mounted in a through hole formed in a transmission casing, an O-ring 8, mounted on an outer peripheral surface of the housing 5, forms a liquid-tight seal between the transmission casing and the housing 5, and the cured epoxy resin seals the space 7 within the housing 5 in a liquid-tight manner, and therefore oil within the transmission casing will not leak to the exterior.

Then, when a mating connector (not shown) is connected to this connector 1, solenoids and so on, mounted inside the transmission, are connected to a control unit or the like provided outside the transmission casing.

In the above conventional connector 1, however, the epoxy resin solution is poured into the housing 5, and therefore the rubber plug 6 for preventing the epoxy resin solution from leaking to the exterior of the housing 5 is needed. Therefore, the number of the component parts is increased, and hence the cost is increased, and besides much time and labor are required for the assembling operation, thus inviting problems that the cost is increased and that the productivity is lowered.

And besides, when pouring the epoxy resin into the housing 5, the epoxy resin solution may adhere to the connection terminals 3 and the amount of the poured epoxy resin solution may become insufficient.

Further, much time is required for heating and setting the epoxy resin. Furthermore, if the epoxy resin adheres to the hand of the operator, it may causes a rash.

SUMMARY OF THE INVENTION

This invention seeks to overcome the above problems, and an object of the invention is to provide a connector and a method of assembling a connector in which the interior of a connector housing can be sealed liquid-tight, and also the number of component parts is small, and the connector can be assembled easily.

According to the first aspect of the invention, there is provided a connector which comprises a housing including a terminal receiving chamber into which a terminal is insertable; a partition wall dividing an internal space of the terminal receiving chamber into a first portion and a second portion, the partition wall having a hole through which the terminal is extended from the first portion into the second portion when the terminal is inserted into the terminal receiving chamber; and micro-capsules each containing an adhesive solution, the micro-capsules being provided on at least an inner surface of the hole, in which when the terminal is inserted into the terminal receiving chamber, the micro-capsules are ruptured by a pressure produced when the terminal is fitted in the hole of the partition wall, so that the adhesive solution is released from the micro-capsules and adhesively bonds the terminal to the inner surface of the hole in a liquid-tight manner.

Furthermore, according to the second aspect of the invention, there is provided a method of assembling a connector comprising a housing including a terminal receiving chamber into which a terminal is insertable, and a partition wall dividing an internal space of the terminal receiving chamber into a first portion and a second portion, the partition wall having a hole through which a distal end portion of the terminal is extended from the first portion into the second portion when the terminal is inserted into the terminal receiving chamber, comprises: a step of providing micro-capsules each containing an adhesive solution; a step of applying the micro-capsules to at least an inner surface of the hole; and a step of rupturing the micro-capsules by inserting the terminal into the hole of the partition wall, so that the adhesive solution is released from the micro-capsules and adhesively bonds the terminal to the inner surface of the hole in a liquid-tight manner.

The interior of the housing is not sealed liquid-tight by pouring an epoxy resin solution, and this obviates the need for a rubber plug or the like for preventing the epoxy resin solution from leaking to the exterior of the housing, and therefore the number of the component parts is reduced.

And besides, much time is not required for heating and setting the epoxy resin, and the assembling operation is completed merely by fitting the terminal in the hole formed through the partition wall, and therefore the assembling operation can be quite easily effected in a short time.

The adhesive solution, for bonding the terminal to the inner surface of the hole, is sealed in the micro-capsules, and therefore when the micro-capsules are applied to the inner surface of the hole, the adhesive solution is not exposed to the exterior of the micro-capsules, and therefore will not drop from the inner surface of the hole, and hence will not lose its bonding ability.

Therefore, the reliability of the connector is enhanced, and the connector-producing cost is reduced, and the productivity is enhanced.

DETAILED DESCRIPTION OF THE PREFERRED EMBODIMENT

One preferred embodiment of a connector and a method of assembling a connector of the present invention will now be described in detail with reference to FIGS. 1 and 2.

Figure 1:
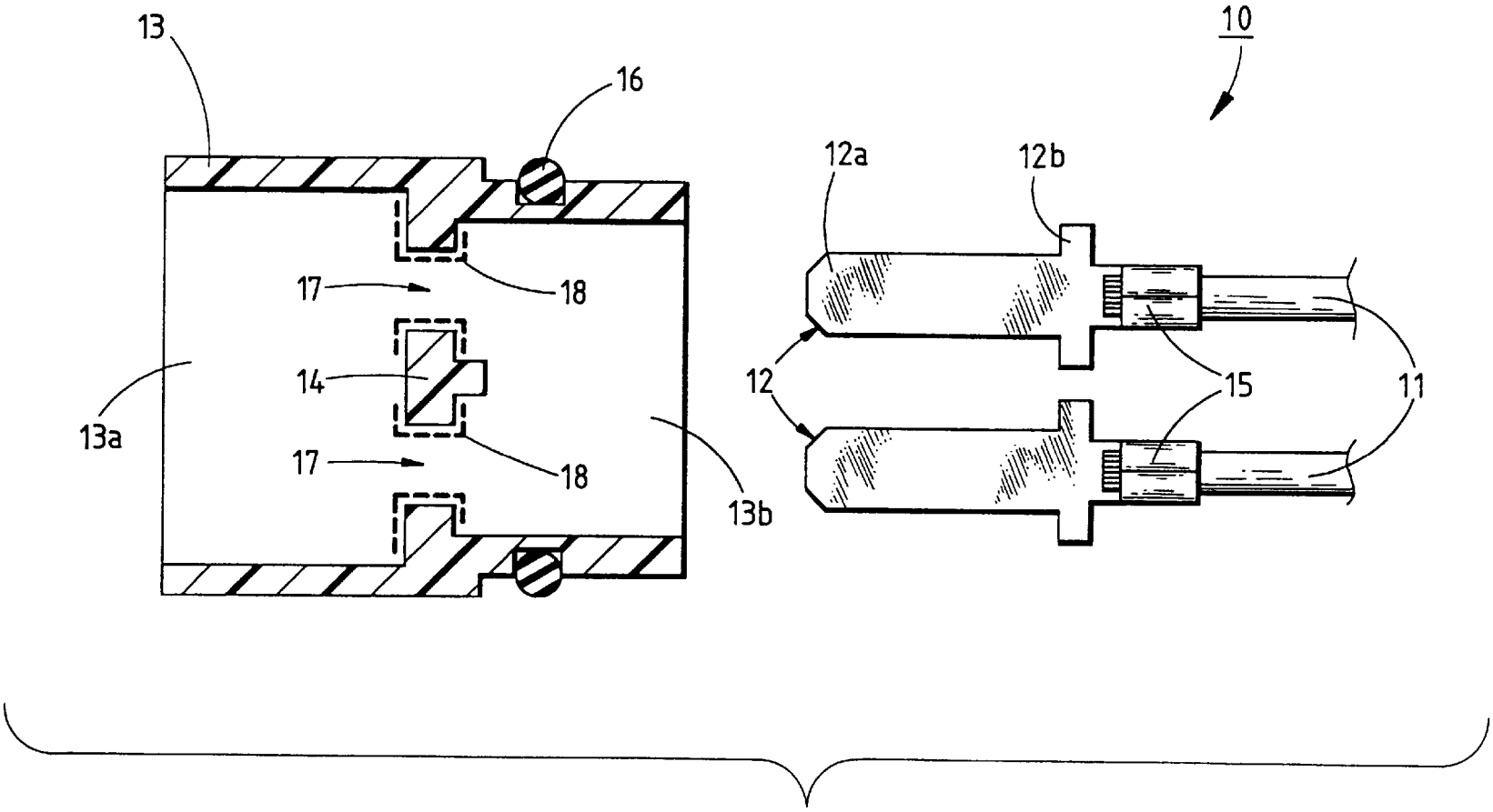
FIG. 1 is a cross-sectional view of one preferred embodiment of a connector of the invention in a disassembled condition.
Figure 2:
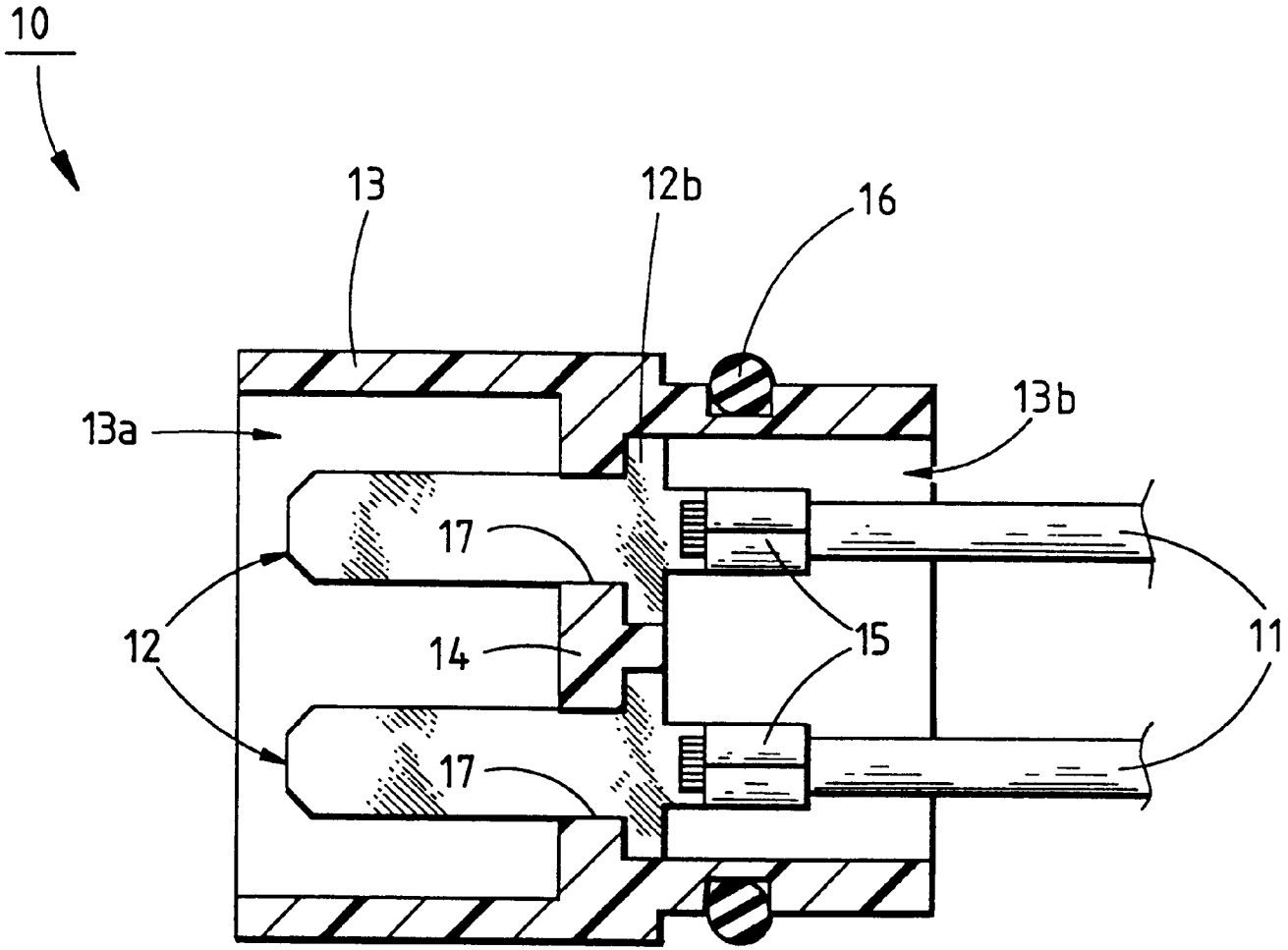
FIG. 2 is a cross-sectional view of the connector of FIG. 1 in an assembled condition.

As shown in FIGS. 1 and 2, the connector 10 of this embodiment includes a housing 13 of a synthetic resin for receiving connection terminals 12 fixedly connected respectively to distal ends of electric wires 11 to be arranged inside a transmission of an automobile. An internal space of the housing 13 is divided by a partition wall 14 into a mating terminal-receiving chamber 13*a* for receiving terminals of a mating connector and a fixing portion-receiving chamber 13b for receiving fixing portions 15 of the connection terminals 12 to which the electric wires 11 are fixedly connected, respectively.

An O-ring 16 is mounted on an outer peripheral surface of the fixing portion-receiving chamber 13*b*, and is adapted to be held in intimate contact with an inner surface of a connector mounting hole formed through a wall of a transmission casing (not shown). Connection terminal-fitting holes 17 are formed through the partition wall 14, and distal end portions 12*a* of the connection terminals 12 are fitted respectively in these connection terminal-fitting holes 17.

As shown by thick broken-lines in FIG. 1, micro-capsules 18 each containing an adhesive solution, are coated on inner surfaces of the connection terminal-fitting holes 17 and their vicinities after the micro-capsules 18 have been mixed in a binder. More specifically, an adhesive solution of the epoxy or acrylic series is sealed in each of the micro-capsules 18. One example of such product has been marketed by THREE BOND under the tradename of "MEC PROCESSING". Each of the micro-capsules 18 can be broken or ruptured upon application of a pressure.

The micro-capsules 18 are coated on the inner surfaces of the connection terminal-fitting holes 17 and their vicinities, and in this condition the adhesive solution, for bonding the connection terminals 12 respectively to the inner surfaces of the connection terminal-fitting holes 17, is not exposed to the exterior of the micro-capsules 18, and therefore will not drop from the inner surfaces of the connection terminal-fitting holes 17, and hence will not lose its bonding ability.

When the connection terminal 12 is fitted in the connection terminal-fitting hole 17, the micro-capsules 18 are held between the connection terminal 12 and the connection terminal-fitting hole 17, and are easily ruptured by this pressure, so that the adhesive solution, sealed in the micro-capsules, is released therefrom. As a result, the connection terminal 12 is firmly bonded to the inner surface of the connection terminal-fitting hole 17, and a gap between the connection terminal and the connection terminal-fitting hole 17 is sealed liquid-tight.

Therefore, the mating terminal-receiving chamber 13*a* in the housing 13 is sealed liquid-tight relative to the fixing portion-receiving chamber 13*b*, and therefore oil, rising from the transmission casing along the electric wires 11, will not intrude into the mating terminal-receiving chamber 13*a*.

Next, the assembling of the connector 10 of this embodiment will be described. First, the micro-capsules 18 are coated through the binder on the inner surfaces of the connection terminal-fitting holes 17 and their vicinities, and are dried.

Then, the distal end portion 12*a* of each connection terminal 12 is fitted in the associated connection terminal-fitting hole 17, formed through the partition wall 14, until a stopper 12*b* of the connection terminal 12 is brought into contact with the surface of the partition wall 14 of the housing 13, and by doing so, the assembling of the connector 10 of this embodiment is completed. As a result, the gap between each connection terminal 12 and the partition wall 14 is sealed liquid-tight, and therefore, the oil, rising from the transmission casing along the electric wires 11, will not intrude into the mating terminal-receiving chamber 13*a* of the housing 13.

Figure 3:
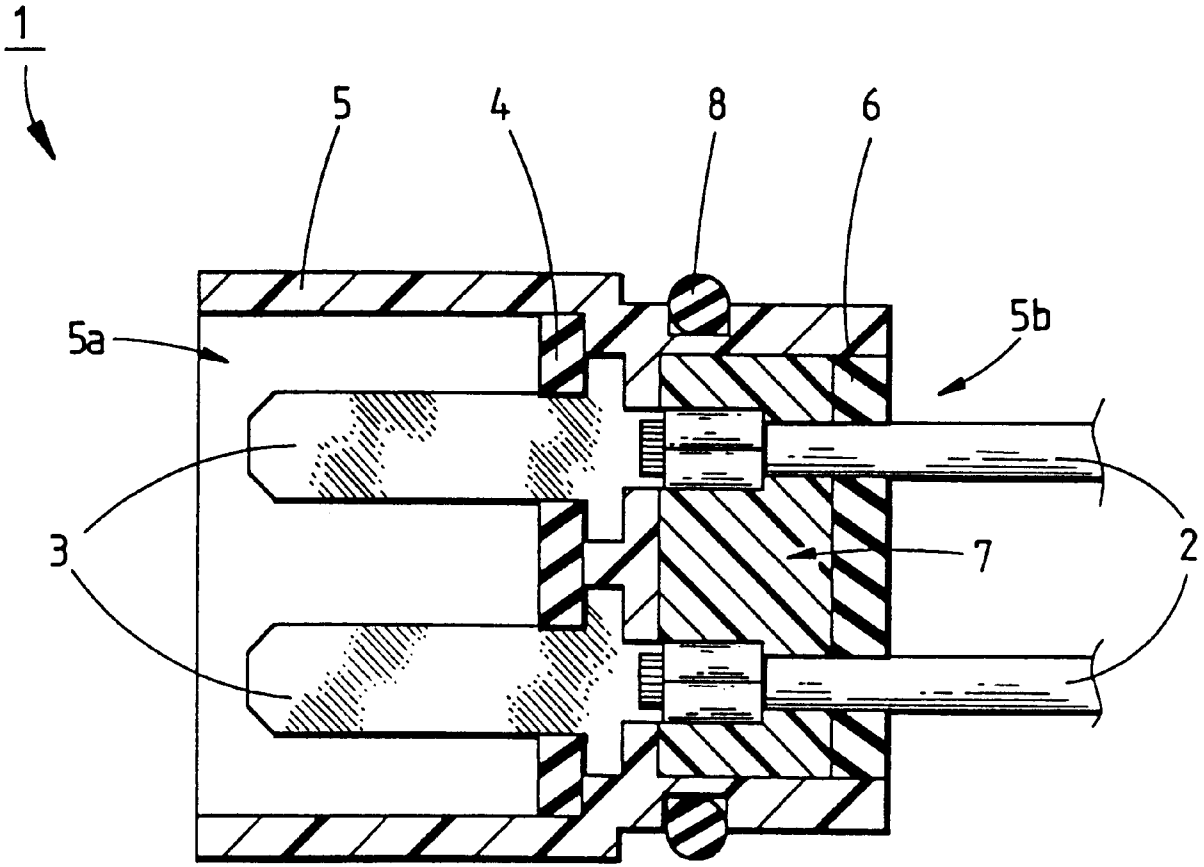
FIG. 3 PRIOR ART
FIG. 3 is a cross-sectional view of a conventional connector.

In the connector 10 of this embodiment, the connection terminals 12 are adhesively bonded respectively to the inner surfaces of the connection terminal-fitting holes 17, formed through the partition wall 14, by the micro-capsules 18, and the gap between each connection terminal 12 and the inner surface of the associated connection terminal-fitting hole 17 is sealed liquid-tight. Therefore, an epoxy resin solution as used in the conventional connector 1 of FIG. 3 does not need to be used for sealing the interior of the housing 13 in a liquid-tight manner.

This obviates the need for a rubber plug or the like for preventing the epoxy resin solution from leaking to the exterior of the housing 13, and therefore the number of the component parts is reduced.

And besides, much time is not required for heating and setting the epoxy resin, and hence the assembling operation can be finished in a short time. Furthermore, there is not encountered a situation in which the epoxy resin adheres to the hand of the operator.

The assembling operation is completed merely by fitting the connection terminals 12 respectively in the connection terminal-fitting holes 17, and therefore the efficiency of the assembling operation is quite high.

The present invention is not limited to the connector of the above embodiment, but various modifications can be made. For example, in the above embodiment, although each of the connection terminals 12 is a male terminal in the form of a flat plate, it may have any other suitable shape in so far as it can be snugly fitted in the connection terminal-fitting hole 17, and female terminals may be used.

As described above, the connector of the present invention includes the housing for receiving the connection terminals fixedly connected respectively to the distal ends of the electric wires, and the partition wall which divides the internal space of the housing into the two chambers, and has the connection terminal-fitting holes formed therethrough, and the distal end portion of each of the connection terminals is projected from one of the two chambers into the other chamber through the associated connection terminal-fitting hole, and the micro-capsules each containing an adhesive solution are provided at least on the inner surface of each of the connection terminal-fitting holes. The micro-capsules are ruptured by a pressure produced when each of the connection terminals is fitted in the associated connection terminal-fitting hole, so that the adhesive solution is released therefrom and adhesively bonds the connection terminal to the inner surface of the connection terminal-fitting hole in a liquid-tight manner.

Therefore, the interior of the housing is not sealed liquid-tight by an epoxy resin solution, and this obviates the need for a rubber plug or the like for preventing the epoxy resin solution from leaking to the exterior of the housing, and therefore the number of the component parts is reduced.

And besides, much time is not required for heating and setting the epoxy resin, and hence the assembling operation can be finished in a short time, and the assembling operation is completed merely by fitting the connection terminals respectively in the connection terminal-fitting holes formed through the partition wall of the housing, and therefore the efficiency of assembling of the connector is quite high.

The micro-capsules are used for adhesively bonding the connection terminals to the housing, and therefore the adhesive solution is not exposed to the exterior of the micro-capsules before the connection terminal is fitted in the connection terminal-fitting hole, and therefore will not flow out of the connection terminal-fitting hole, and hence will not lose the ability of bonding the connection terminal to the inner surface of the connection terminal-fitting hole.

Therefore, the reliability of the connector is enhanced, and the connector-producing cost is reduced, and the productivity is enhanced.

What is claimed is:

1. A connector, comprising:

a housing including a terminal receiving chamber into which a terminal is insertable;

a partition wall dividing an internal space of the terminal receiving chamber into a first portion and a second portion, the partition wall having a hole through which the terminal is extended from the first portion into the second portion when the terminal is inserted into the terminal receiving chamber; and micro-capsules each containing an adhesive solution, the micro-capsules being provided on at least an inner surface of the hole, wherein when the terminal is inserted into the terminal receiving chamber, the micro-capsules are ruptured by a pressure produced when the terminal is fitted in the hole of the partition wall, so that the adhesive solution is released from the micro-capsules and adhesively bonds the terminal to the inner surface of the hole in a liquid-tight manner.

* * * * *